US010429876B2

(12) United States Patent
Jo et al.

(10) Patent No.: US 10,429,876 B2
(45) Date of Patent: Oct. 1, 2019

(54) REFERENCE CURRENT GENERATING CIRCUIT WITH PROCESS VARIATION COMPENSATION

(71) Applicant: Samsung Electro-Mechanics Co., Ltd., Suwon-si (KR)

(72) Inventors: Byeong Hak Jo, Suwon-si (KR); Jeong Hoon Kim, Suwon-si (KR); Kyu Jin Choi, Suwon-si (KR); Jong Ok Ha, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 15/986,209

(22) Filed: May 22, 2018

(65) Prior Publication Data

US 2019/0072993 A1 Mar. 7, 2019

(30) Foreign Application Priority Data

Sep. 1, 2017 (KR) ..... 10-2017-0112016

(51) Int. Cl.
*G05F 3/10* (2006.01)
*G05F 3/26* (2006.01)

(52) U.S. Cl.
CPC . *G05F 3/26* (2013.01); *G05F 3/10* (2013.01)

(58) Field of Classification Search
None
See application file for complete search history.

(56) References Cited

U.S. PATENT DOCUMENTS

2005/0030090 A1* 2/2005 Deng ..... G05F 3/245 327/539
2010/0259315 A1* 10/2010 Lin ..... G05F 3/08 327/538
2011/0109373 A1* 5/2011 Chen ..... G05F 3/16 327/513
2013/0009622 A1* 1/2013 Hu ..... G05F 3/30 323/312
2017/0023967 A1* 1/2017 Lee ..... G05F 3/262

* cited by examiner

*Primary Examiner* — Jeffrey A Gblende
(74) *Attorney, Agent, or Firm* — NSIP Law

(57) ABSTRACT

A reference current generating circuit includes a current source circuit configured to generate a reference current based on an internal resistor; and a compensation circuit configured to comprise a first compensation circuit comprising a first compensation resistor and a second compensation resistor, and the first compensation resistor and the second compensation resistor are configured to convert the reference current into a first output current and compensate for process variation of the current source circuit.

18 Claims, 6 Drawing Sheets

REFERENCE CURRENT GENERATING CIRCUIT WITH PROCESS VARIATION COMPENSATION

CROSS-REFERENCE TO RELATED APPLICATION(S)

This application claims the benefit under 35 USC 119(a) of Korean Patent Application No. 10-2017-0112016 filed on Sep. 1, 2017 in the Korean Intellectual Property Office, the entire disclosure of which is incorporated herein by reference for all purposes.

BACKGROUND

1. Field

The following description relates to a reference current generating circuit with process variation compensation.

2. Description of Related Art

In general, an analog radio frequency (RF) circuit uses a reference voltage and a reference current to operate in a stable condition. Such a reference voltage and a reference current are affected by a source voltage, temperature, and process variations.

In particular, a complementary metal-oxide semiconductor (CMOS) based current source circuit appropriately mirrors the reference current and includes a reference current source. When a bandgap reference (BGR) is used, the reference voltage and the reference current, which are very stable with regard to temperature, and the source voltage, may be generated.

Typically, a circuit generating the reference current may be designed in consideration of process, voltage, and temperature (PVT) variations. Examples thereof include a current source having proportional to absolute temperature (PTAT) characteristics, a current source having characteristics independent of a change in temperature, and the like.

In general, a current source having the lowest amount of change is ideal for source voltage (V) and process variations (P) among the PVT items. For temperature (T), a PTAT current source or a current source independent of temperature characteristics may be used according to characteristics required by an analog or RF circuit supplied with the reference current.

The bandgap reference generating the reference current source may be used to meet the temperature characteristics, and a low drop out (LDO) regulator providing a more stable source voltage with respect to a change in the source voltage may be used. However, even in a case in which a current source having a small amount of change is used, when the current source includes a resistor that causes process variations, a problem occurs in that there is a limit in reducing dispersion due to the process variations. As a result, a yield may be decreased.

SUMMARY

This Summary is provided to introduce a selection of concepts in a simplified form that are further discussed below in the Detailed Description. This Summary is not intended to identify key features of the claimed subject matter, nor is this Summary intended to be used as an aid in determining the scope of the claimed subject matter.

In one general aspect, a reference current generating circuit includes a current source circuit configured to generate a reference current based on an internal resistor; and a compensation circuit configured to comprise a first compensation circuit comprising a first compensation resistor and a second compensation resistor, and the first compensation resistor and the second compensation resistor are configured to convert the reference current into a first output current and compensate for process variation of the current source circuit.

The first compensation resistor may have a resistance value that is different from a resistance value of the second compensation resistor.

The first compensation resistor may have a resistance value that is different from a resistance value of the second compensation resistor by a value equal to the process variation.

The input reference current may be converted to the first output current based on a ratio of a resistance value of the first compensation resistor and a resistance value of the second compensation resistor.

The current source circuit may further include a bandgap reference circuit configured to generate a reference voltage and provide the generated reference voltage to one end of the internal resistor; a voltage to current (V/I) conversion circuit configured to comprise the internal resistor connected to an output terminal of the bandgap reference circuit and a ground to convert the reference voltage into an internal current; and a current mirror circuit configured to perform current mirroring for the internal current input from the V/I conversion circuit to generate the reference current.

The first compensation circuit may include a first current to voltage (I/V) conversion circuit configured to comprise a first compensation resistor connected between an output terminal of the current source circuit and a ground to convert the reference current into a first internal voltage; a first buffer configured to output the first internal voltage as a first output voltage; a first voltage to current (V/I) conversion circuit configured to comprise a second compensation resistor connected between an output terminal of the first buffer and the ground to convert the first output voltage into a first internal current; and a first current mirror configured to perform current mirroring for the first internal current of the first V/I conversion circuit to generate the first output current.

According to another aspect, a reference current generating circuit includes a current source circuit configured to generate a reference current based on an internal resistor; and a compensation circuit configured to comprise first to n-th compensation circuits connected in series between the current source circuit and an output terminal and compensate for process variation of the current source circuit by the first to n-th compensation circuits, wherein the first compensation circuit comprises a first compensation resistor and a second compensation resistor, the first compensation resistor and the second compensation resistor are configured to convert an input reference current into a first output current, and the n-th compensation circuit comprises a first compensation resistor and a second compensation resistor to convert an input current into a n-th output current.

The first compensation resistor may have a resistance value that is different from a resistance value of the second compensation resistor.

The first compensation resistor may have a resistance value that is different from a resistance value of the second compensation resistor by a value equal to the process variation.

The input reference current may be converted to the first output current based on a ratio of a resistance value of the first compensation resistor and a resistance value of the second compensation resistor.

The current source circuit may further include a bandgap reference circuit configured to generate a reference voltage and provide the generated reference voltage to one end of the internal resistor; a V/I conversion circuit configured to comprise the internal resistor connected to an output terminal of the bandgap reference circuit and a ground to convert the reference voltage into an internal current; and a current mirror circuit configured to perform current mirroring for the internal current input from the V/I conversion circuit to generate the reference current.

The first compensation circuit may include a first current to voltage (I/V) conversion circuit configured to comprise a first compensation resistor connected between an output terminal of the current source circuit and a ground to convert the reference current into a first internal voltage; a first buffer configured to output the first internal voltage as a first output voltage; a first voltage to current (V/I) conversion circuit configured to comprise a second compensation resistor connected between an output terminal of the first buffer and the ground to convert the first output voltage into a first internal current; and a first current mirror configured to perform current mirroring for the first internal current of the first V/I conversion circuit to generate the first output current.

The n-th compensation circuit may include a n-th I/V conversion circuit configured to comprise an nth compensation resistor connected between an input terminal of the n-th compensation circuit and a ground to convert the input current into a n-th internal voltage; a n-th buffer configured to output the n-th internal voltage as a n-th output voltage; a n-th V/I conversion circuit configured to comprise an n+1 compensation resistor connected between an output terminal of the n-th buffer and the ground to convert the n-th output voltage into a n-th internal current; and a n-th current mirror configured to perform current mirroring for the n-th internal current of the n-th V/I conversion circuit to generate a n-th output current.

According to yet another aspect, a reference current generating circuit includes a current source circuit configured to generate a reference current; and a compensation circuit configured to comprise one or more compensation circuits, each of the one or more compensation circuits comprising a first compensation resistor of a first resistance value and a second compensation resistor of a second resistance value, and the first compensation resistor and the second compensation resistor are configured to convert the reference current into a first output current based on a ratio of the first resistance value and the second resistance value.

The resistance value of the first compensation resistor may be different from the resistance value of the second compensation resistor.

The current source circuit may further include a bandgap reference circuit configured to generate a reference voltage, and a voltage to current (V/I) conversion circuit configured to convert the reference voltage to an internal current.

The reference current generating circuit may further include a current mirror circuit configured to perform current mirroring for the internal current to generate a reference current.

The first resistance value may be different from the second resistance value by a value equal to a process variation of the current source circuit.

The one or more compensation circuit may include a first current to voltage (I/V) conversion circuit configured to comprise the first compensation resistor connected between an output terminal of the current source circuit and a ground to convert the reference current into a first internal voltage; a first buffer configured to output the first internal voltage as a first output voltage; a first voltage to current (V/I) conversion circuit configured to comprise the second compensation resistor connected between an output terminal of the first buffer and the ground to convert the first output voltage into a first internal current; and a first current mirror configured to perform current mirroring for the first internal current of the first V/I conversion circuit to generate the first output current.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
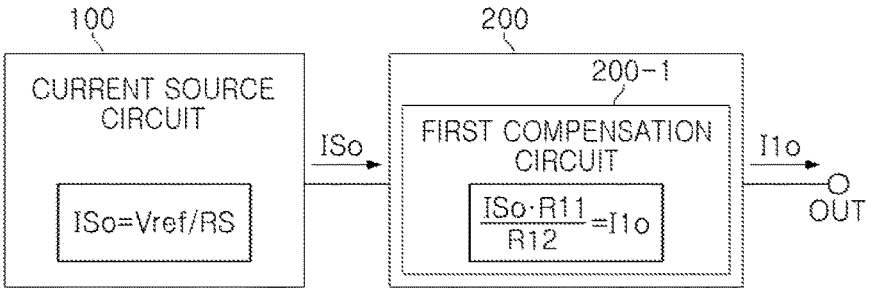
FIG. 1 is a block diagram illustrating an example of a reference current generating circuit of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

FIG. 1 is a block diagram illustrating an example of a reference current generating circuit according to the present disclosure.

Referring to FIG. 1, a reference current generating circuit according to the present disclosure may include a current source circuit 100 and a compensation circuit 200, for example.

The current source circuit 100 may generate a reference current ISo based on an internal resistor RS and a reference voltage Vref. As an example, the current source circuit 100 may generate the reference current ISo (ISo=Vref/RS) using a reference voltage Vref, such as a bandgap reference, and the internal resistor RS.

The current source circuit 100 may use the internal resistor RS to generate the reference current ISo and the internal resistor may include process variations. Therefore, since operational instabilities may be caused by variations such as process variations or the like, process variations due to the internal resistor RS need to be compensated.

The compensation circuit 200 may include a first compensation circuit 200_1. The first compensation circuit 200_1 may include a first compensation resistor R11 and a second compensation resistor R12 to convert the reference current ISo from the current source circuit 100 into a first output current I1*o* and output it through an output terminal OUT, and may compensate for process variations of the current source circuit 100 through the above-mentioned operation.

As an example, the first compensation circuit 200_1 may convert the reference current ISo into the first output current I1*o* using a resistance value ratio (R11/R12) of the first compensation resistor R11 and the second compensation resistor R12 to compensate for the process variations of the current source circuit 100.

For example, the first compensation resistor R11 may have a resistance value different from the second compensation resistor R12 so that the resistance value ratio (R11/R12) is not 1. For example, the first compensation resistor R11 may have a resistance value that is different from the second compensation resistor R12 by the process variations.

Figure 2:
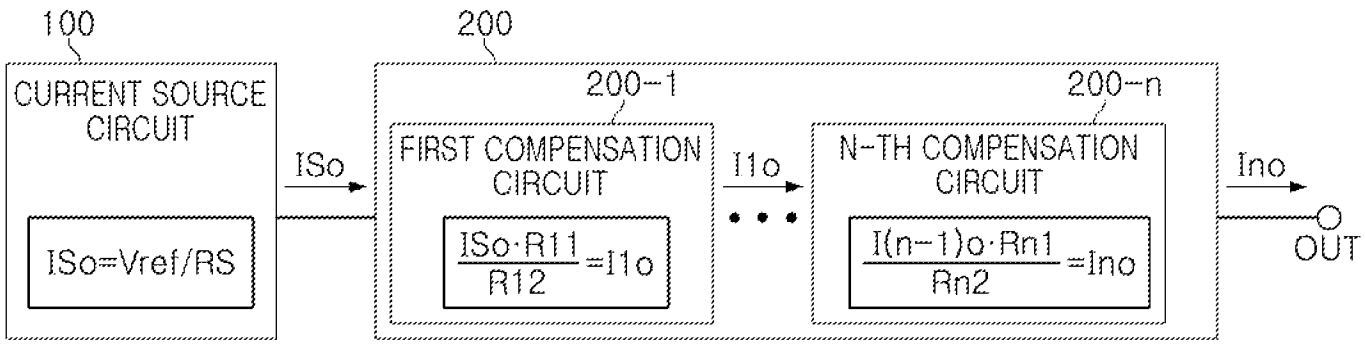
FIG. 2 is a block diagram illustrating an example of a reference current generating circuit of the present disclosure.

FIG. 2 is a block diagram illustrating an example of a reference current generating circuit of in the present disclosure.

Referring to FIG. 2, a reference current generating circuit of the present disclosure may include a current source circuit 100 and a compensation circuit 200, for example.

The current source circuit 100 may generate a reference current ISo using an internal resistor RS and a reference voltage Vref. As an example, the current source circuit 100 may generate the reference current ISo (ISo=Vref/RS) using a reference voltage Vref, such as a bandgap reference, and the internal resistor RS.

The compensation circuit 200 may include first to n-th compensation circuits 200-01 to 200-*n* connected between the current source circuit 100 and an output terminal OUT in series.

The first compensation circuit 200-1 may include a first compensation resistor R11 and a second compensation resistor R12 to convert an input reference current ISo into a first output current I1*o*. The n-th compensation circuit 200-*n* may include a first compensation resistor Rn1 and a second compensation resistor Rn2 to convert an input current I(n−1)o into a n-th output current Ino. In this case, the current I(n−1)o may be a current output from a n−1-th compensation circuit 200-*n*−1 (not shown) connected to an input terminal of the n-th compensation circuit 200-*n*.

By the operation as described above, the first compensation circuit 200-1 and the n-th compensation circuit 200-*n* may compensate for the process variations of the current source circuit 100.

As an example, the first compensation circuit 200-1 may convert the reference current ISo into the first output current I10 using a resistance value ratio (R11/R12) of the first compensation resistor R11 and the second compensation resistor R12.

For example, the first compensation resistor R11 may have a resistance value that is different from the second compensation resistor R12 so that the resistance value ratio (R11/R12) is not 1. For example, the first compensation resistor R11 may have a resistance value different from a resistance value of the second compensation resistor R12 by an amount equal to the process variations.

As an example, the n-th compensation circuit 200-*n* may convert an input reference current I(n−1)o into the n-th output current Ino based on a resistance value ratio (Rn1/Rn2) of the first compensation resistor Rn1 and the second compensation resistor Rn2.

For example, the first compensation resistor Rn1 may have a resistance value different from the second compensation resistor Rn2 so that the resistance value ratio (Rn1/Rn2) is not 1. For example, the first compensation resistor Rn1 may have a resistance value that is different from a resistance value of the second compensation resistor Rn2 by an amount equal to the process variations. However, this is only an example, and the resistance values of the first compensation resistor and the second compensation resistor may vary by differing values.

In the respective drawings of the present disclosure, unnecessarily overlapped descriptions may be omitted for components having the same reference numeral and the same function, and only differences in the respective drawings will be described.

Figure 3:
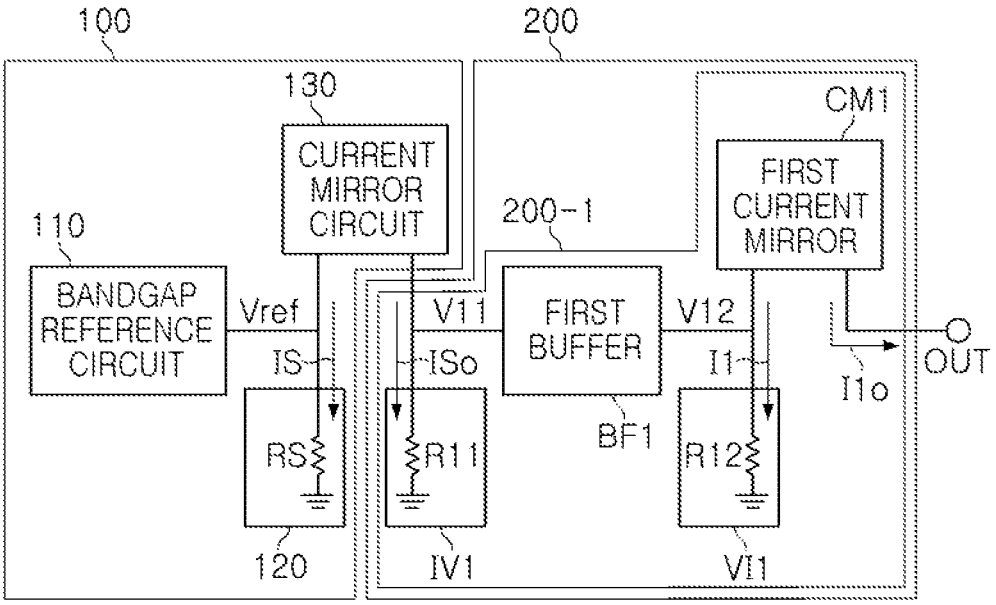
FIG. 3 is a detailed block diagram illustrating an example of a reference current generating circuit.
Figure 4:
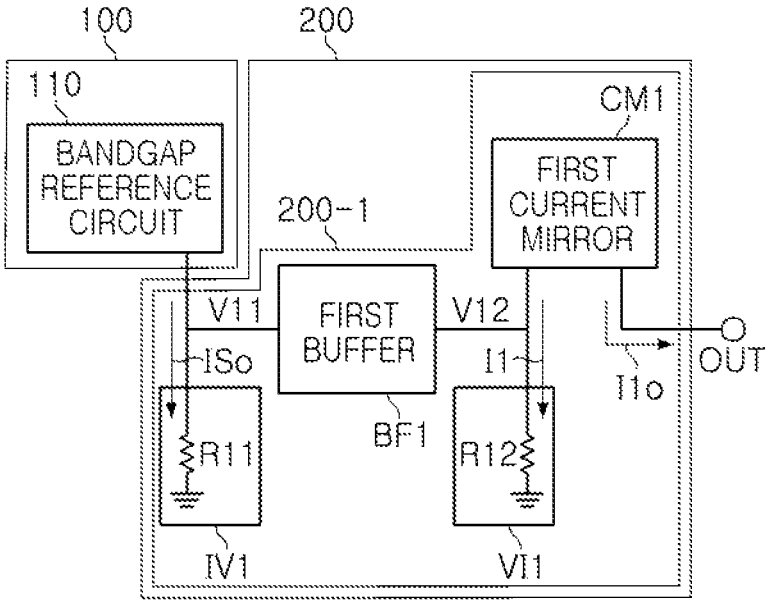
FIG. 4 is a detailed block diagram illustrating an example of a reference current generating circuit.

FIGS. 3 and 4 are detailed block diagrams illustrating examples of a reference current generating circuit. For explanation purposes the reference current generating circuit will be discussed with reference to the reference generating circuit of FIG. 1. Note that examples are not limited thereto.

Referring to FIG. 3, the current source circuit 100 may include a bandgap reference circuit 110, a voltage to current (V/I) conversion circuit 120, and a current mirror circuit 130.

The bandgap reference circuit 110 may generate a reference voltage Vref to be provided to one terminal of the V/I conversion circuit 120.

The V/I conversion circuit 120 may include the internal resistor RS connected to an output terminal of the bandgap reference circuit 110 and a ground. The VI conversion circuit 120 may convert the reference voltage Vref into an internal current IS based on the internal resistor RS.

The current mirror circuit 130 may perform current mirroring for the internal current generated by the V/I conversion circuit 120 to generate the reference current ISo.

Referring to FIGS. 3 and 4, the first compensation circuit 200-1 may include a first I/V conversion circuit IV1, a first buffer BF1, a first V/I conversion circuit VI1, and a first current mirror CM1.

The first I/V conversion circuit IV1 may include the first compensation resistor R11 connected between the output terminal of the current source circuit 100 and the ground to convert the reference current ISo input from the current source circuit 100 into a first internal voltage V11 using the second compensation resistor R12.

The first buffer BF1 may output the first internal voltage V11 as a first output voltage V12. As an example, when an amplification factor of the first buffer BF1 is "1", a magnitude of the first internal voltage V11 may be equal to a magnitude of the first output voltage V12.

The first V/I conversion circuit VI1 may include the second compensation resistor R12 connected between an output terminal of the first buffer BF1 and the ground to convert the first output voltage V12 into an internal current I1.

In addition, the first current mirror CM1 may perform current mirroring for the first internal current I1 of the first V/I conversion circuit VI1 to generate the first output current I1*o*.

In addition, in the current source circuit 100 and the compensation circuit 200, the first output current I1*o* may be generated based on the reference voltage Vref, the internal resistor RS, the first compensation resistor R11, and the second compensation resistor R12 as in Equation 1 below.

$$I1o = Vref*(1/RS)*(R11)/(R12) \quad \text{[Equation 1]}$$

Referring to Equation 1, in a case in which the first output current I1*o* is determined only by the internal resistor RS, the first output current I1*o* may be greatly affected by process variations of the internal resistor RS.

However, in a case in which the first output current I1*o* is determined by the first compensation resistor R11 and the second compensation resistor R12 as well as the internal resistor RS, it may be seen that the first output current I1*o* is less affected by the process variations of the internal resistor RS by the first compensation resistor R11 and the second compensation resistor R12.

Figure 5:
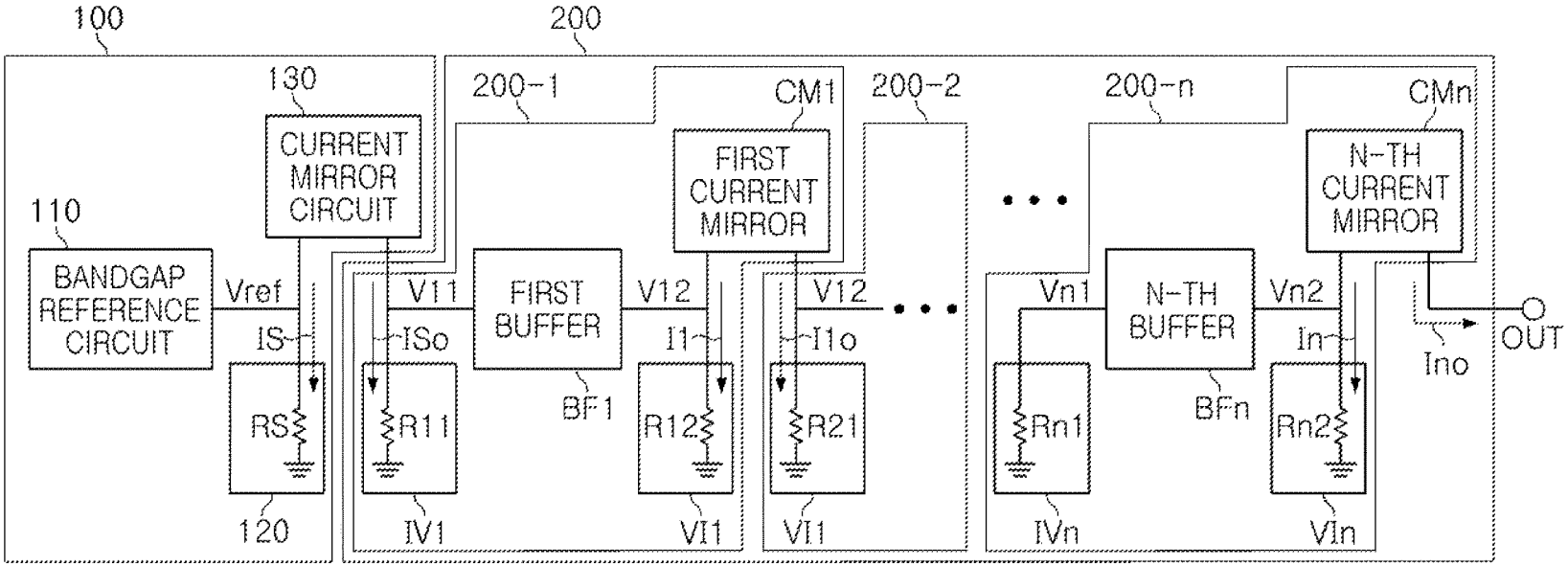
FIG. 5 is a detailed block diagram illustrating an example of a reference current generating circuit.
Figure 6:
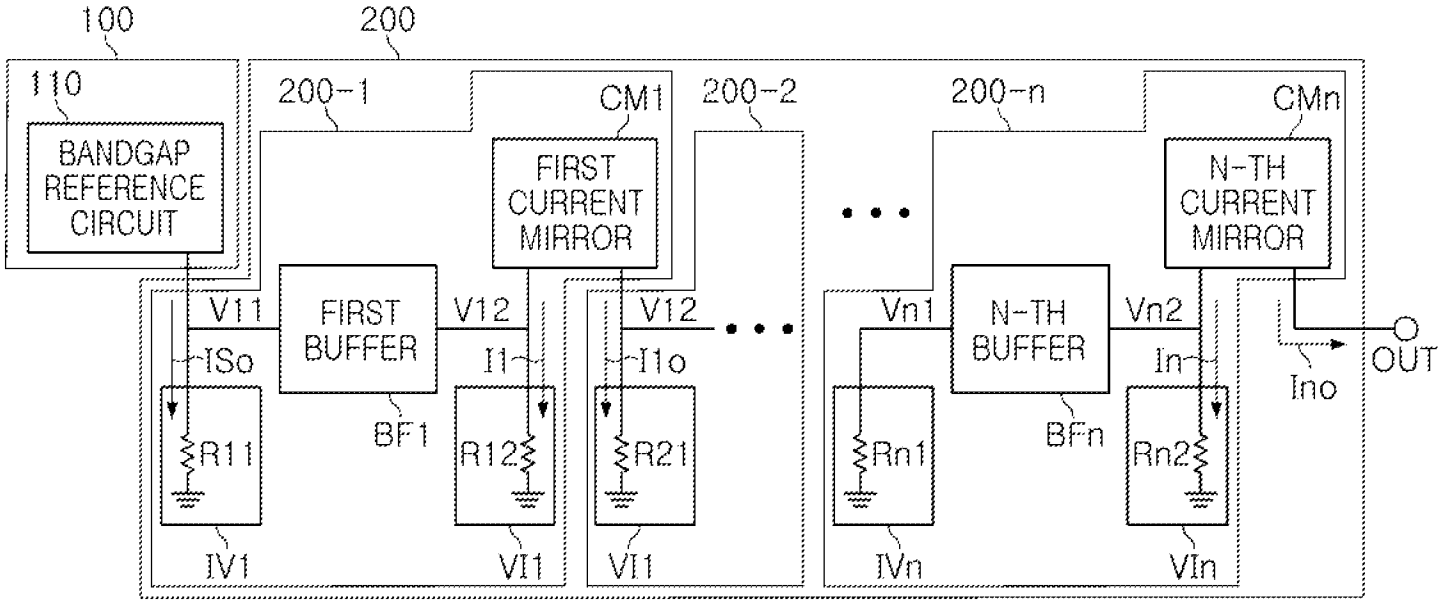
FIG. 6 is a detailed block diagram illustrating an example of a reference current generating circuit.

FIGS. 5 and 6 are detailed block diagrams illustrating examples of a reference current generating circuit. For explanation purposes the reference current generating circuit will be discussed with reference to the reference generating circuit of FIG. 2. Note that examples are not limited thereto. Referring to FIG. 5, the current source circuit 100 may include a bandgap reference circuit 110, an V/I conversion circuit 120, and a current mirror circuit 130.

The bandgap reference circuit 110 may generate a reference voltage Vref to be provided to one terminal of the V/I conversion circuit 120.

The V/I conversion circuit 120 may include the internal resistor RS connected to an output terminal of the bandgap reference circuit 110 and a ground to convert the reference voltage Vref into an internal current IS based on the internal resistor RS.

The current mirror circuit 130 may perform current mirroring for the internal current IS generated by the V/I conversion circuit 120 to generate the reference current ISo.

Referring to FIGS. 5 and 6, the first compensation circuit 200-1 may include a first I/V conversion circuit IV1, a first buffer BF1, a first V/I conversion circuit VI1, and a first current mirror CM1.

The first I/V conversion circuit IV1 may include the first compensation resistor R11 connected between the output terminal of the current source circuit 100 and the ground to convert the reference current ISo into a first internal voltage V11 using the second compensation resistor R11.

The first buffer BF1 may output the first internal voltage V11 as a first output voltage V12.

The first V/I conversion circuit VI1 may include the second compensation resistor R12 connected between an output terminal of the first buffer BF1 and the ground to convert the first output voltage V12 into a first internal current I1 based on the second compensation resistor R12.

In addition, the first current mirror CM1 may perform current mirroring for the first internal current I1 of the first V/I conversion circuit VI1 to generate the first output current I1*o*, The n-th compensation circuit 200-*n* may include a n-th I/V conversion circuit IVn, a n-th buffer BFn, a n-th V/I conversion circuit VIn, and a n-th current mirror CMn.

The n-th I/V conversion circuit IVn may include the first compensation resistor Rn1 connected between an input terminal of the n-th compensation circuit 200-*n* and the ground to convert an input current I(n−1)o into a n-th internal voltage Vn1 using the first compensation resistor Rn1

The n-th buffer BFn may output the n-th internal voltage Vn1 as a n-th output voltage Vn2.

The n-th V/I conversion circuit VIn may include the second compensation resistor Rn2 connected between an output terminal of the n-th buffer BFn and the ground to convert the n-th output voltage Vn2 into a n-th internal current In using the second compensation resistor Rn2.

In addition, the n-th current mirror CMn may perform current mirroring for the n-th internal current In of the n-th V/I conversion circuit VIn to generate the n-th output current Ino, Here, n is a natural number of 2 or more.

In addition, in the current source circuit 100 and the compensation circuit 200, the n-th output current Ino may be generated by using the reference voltage Vref, the internal resistor RS, the first compensation resistors R11 to Rn1, and the second compensation resistors R12 to Rn2 as in Equation 2 below.

$$I1o = Vref*(1/RS)*(R11)/(R12) = ISo*(R11)/(R12) \quad \text{[Equation 2]}$$

$$I2o = Vref*(1/RS)*(R11)/(R12)*(R21)/(R22) = I1o*(R21)/(R22)$$

$$Ino = Vref*(1/RS)*(R11)/(R12)\cdots(R(n-1)1)/(R(n-1)2)(Rn1)/(Rn2) = I(n-1)o*(Rn1)/(Rn2)$$

Referring to Equation 2, in a case in which the n-th output current Ino is determined only by the internal resistor RS, the n-th output current Ino may be greatly affected by process variations of the internal resistor RS.

However, in a case in which the n-th output current Ino is determined by the first compensation resistors R11 to Rn1 and the second compensation resistors R12 to Rn2 as well as the internal resistor RS, it may be seen that the n-th output current Ino is less affected by the process variations of the internal resistor RS by the first compensation resistors R11 to Rn1 and the second compensation resistors R12 to Rn2.

A resistance equation related to the resistors in Equation 2 above may be expressed as in Equation 3 below.

$$(1/RS)*(R11)/(R12)\ldots(R(n-1)1)/(R(n-1)2)(Rn1)/(Rn2) \quad \text{[Equation 3]}$$

In Equations 2 and 3, if K maintains a constant value even if R varies with respect to the process variations, the process variations of the current source circuit may be maintained to be constant irrespective of R. K will be described in more detail. In a case in which at least two kinds of resistors are used in a manufacturing process, assuming that two resistors are Ra and Rb, process variations are A and B, respectively, and n terminals of the compensation circuit are connected to each other as in Equation 3, the number of resistors (Ra) of numerator of K may be n and the number of resistors (Rb+Rs) of denominator may be n+1.

A resistance equation of a case in which there is no process variations may be expressed as in Equation 4 below, and a resistance equation of a case in which there is a process variation may be expressed as in Equation 5 below.

$$Ko=Ra^n/R^{n+1} \quad \text{[Equation 4]}$$

$$K1=(1+A)^n/(1+B)^{n+1}*Ra^n/Rb^{n+1} \quad \text{[Equation 5]}$$

Here, each of the process variations A and B may be determined during a process selection, and referring to Equations 4 and 5, in order for the current source circuit to maintain a constant value regardless of the process variations, Ko=K1, so that a relationship shown in Equation 6 below may be established.

$$(1+A)^n/(1+B)^{n+1}=1 \quad \text{[Equation 6]}$$

A value "n" satisfying Equation 6 above may be expressed as in Equation 7 below.

$$n=(\log(1+B))/\{(\log(1+A))-(\log(1+B))\} \quad \text{[Equation 7]}$$

For example, if A=0.3 and B=0.15, n=1.14, such that an integer of n may be 1 and n may be 3. Here, assuming that n is the number of stages of the compensation circuit, since n=3 means that it all three resistors including the internal resistor RS and two resistors (first and second compensation resistors), the compensation circuit 200 may be a structure including the first compensation circuit 200-1. In this case, the first output current I1*o* may be determined as in Equation 8 below.

$$I1o-\text{Vref}*(1/RS)*(R11)/(R12) \quad \text{[Equation 8]}$$

In addition, a current I1*o*' of the current source circuit by the process variations may be expressed as in Equation 9 below.

$$I1o' = (1+A)/(1+B)^2*I1o = (1.3)/(1.15*1.15)*I1o = 0.983*I1o \quad \text{[Equation 9]}$$

Referring to Equation 9 above, in a case in which an internal resistor having the process variation B of 0.15 is used, a typical process variation is 15% while a process variation according to an example of the present disclosure is 1.7%. As a result, it may be seen that the process variation may be improved from 15% to 1.7%.

Figure 7:
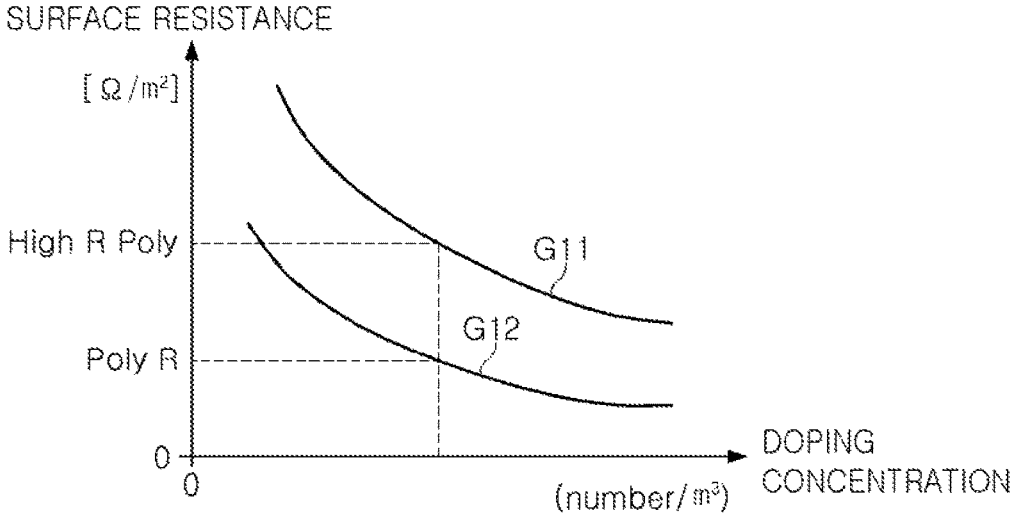
FIG. 7 is a graph illustrating doping concentration-surface resistance characteristics of a first compensation resistor and a second compensation resistor of the present disclosure.

FIG. 7 is an example of a graph illustrating doping concentration-surface resistance characteristics of a first compensation resistor and a second compensation resistor according to the present disclosure.

In FIG. 7, a vertical axis denotes surface resistance ($\Omega/m^2$), a horizontal axis denotes a doping concentration (number/$m^2$), graph G11 denotes a doping concentration-surface resistance characteristic graph for a high resistance (high-R) polysilicon (poly) resistor, and graph G12 denotes a doping concentration-surface resistance characteristic graph for a poly R resistor.

As an example, the first compensation resistors R11 to Rn1 may be the high-R poly resistors and the second compensation resistors R12 to Rn2 may be the poly R resistors, and vice versa.

As an example, the process variations of the high-R poly resistor and the poly R resistor may change in the same direction and may have variation of about two times. Since the high-R poly resistor and the poly R resistor may be the same poly resistor, the process variations thereof may be the same direction and the process variation may be approximately two times.

Referring to G11 and G12 of FIG. 7, it may be seen that surface resistances of the high-R poly resistor and the poly R resistor are changed according to the doping concentration, and the surface resistances are changed to the same extent in the same direction when doping concentrations of both resistors are changed by the process variation.

As described above, in a case in which the high-R poly resistor and the poly R resistor are used as the first compensation resistors R11 to Rn1 and the second compensation resistors R12 to Rn2, the high-R poly resistor and the poly R resistor may have different surface resistances according to the process variation.

Figure 8:
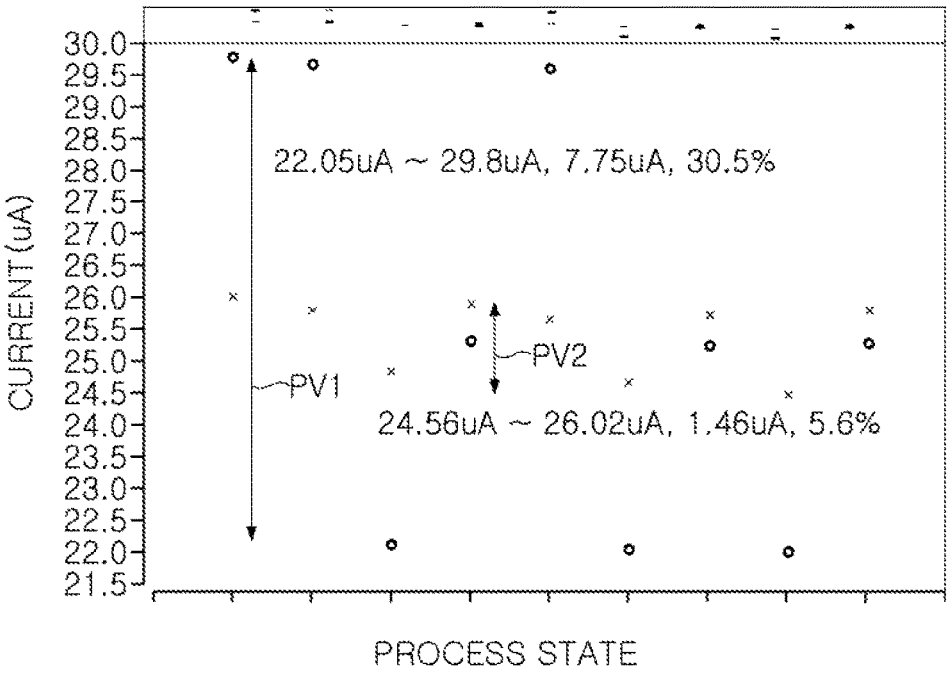
FIG. 8 is a graph illustrating a process variation simulation result for the reference current generating circuit of FIG. 3.

FIG. 8 is an example of a graph illustrating a process variation simulation result for a reference current generating circuit of FIG. 3.

In FIG. 8, a vertical axis denotes a current (μA), a horizontal axis denotes a process state in which process cases are different from each other, PV1 denotes process variation of the typical current source circuit, and PV2 denotes process variation of a current source circuit according to an example of the present disclosure.

Referring to PV1 and PV2 illustrated in FIG. 8, since the typical current source circuit has process variation of 30.5% but the current source circuit according to the present disclosure has process variation of 5.6%, it may be seen that the effect on the process variation is improved as compared to the typical current source circuit.

As set forth above, according to the present disclosure, when the output current is determined by the first compensation resistor and the second compensation resistor as well as the internal resistor, the output current may be less affected by the process variation of the internal resistor by the first compensation resistor and the second compensation resistor.

As a result, the current source circuit may be insensitive to the process variation and may perform a more accurate operation.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A reference current generation circuit comprising:

a current source circuit configured to generate a reference current based on a resistor of the current source circuit; and a compensation circuit which comprises a first compensation circuit, the first compensation circuit comprising:

a first compensation resistor;

a second compensation resistor;

a first current to voltage (I/V) conversion circuit comprising the first compensation resistor connected between an output terminal of the current source circuit and a ground, wherein the first compensation resistor is configured to convert the reference current into a first internal voltage;

a first buffer configured to output the first internal voltage as a first output voltage;

a first voltage to current (V/I) conversion circuit comprising the second compensation resistor connected between an output terminal of the first buffer and the ground, wherein the second compensation resistor is configured to convert the first output voltage into a first internal current; and a first current mirror configured to perform current mirroring for the first internal current of the first V/I conversion circuit to generate a first output current, wherein the first compensation resistor and the second compensation resistor are configured to convert the reference current into the first output current and are configured to compensate for process variation of the current source circuit.

2. The reference current generation circuit of claim 1, wherein the first compensation resistor is configured to have a resistance value that is different from a resistance value of the second compensation resistor.

3. The reference current generation circuit of claim 1, wherein the first compensation resistor is configured to have a resistance value that is different from a resistance value of the second compensation resistor by a value equal to the process variation.

4. The reference current generation circuit of claim 1, wherein the input reference current is converted to the first output current based on a ratio of a resistance value of the first compensation resistor and a resistance value of the second compensation resistor.

5. The reference current generation circuit of claim 1, wherein the current source circuit further comprises:

a bandgap reference circuit configured to generate a reference voltage and provide the generated reference voltage to one end of the resistor of the current source circuit;

a second voltage to current (V/I) conversion circuit comprising the resistor of the current source circuit, wherein the resistor of the current source circuit is connected to an output terminal of the bandgap reference circuit and a ground, and is configured to convert the reference voltage into a second internal current; and a current mirror circuit configured to perform current mirroring for the internal current input from the second V/I conversion circuit to generate the reference current.

6. A reference current generation circuit comprising:

a current source circuit configured to generate a reference current based on a resistor of the current source circuit; and a compensation circuit which comprises first to n-th compensation circuits connected in series between the current source circuit and an output terminal, and the first to n-th compensation circuits are configured to compensate for process variation of the current source circuit, wherein the first compensation circuit comprises a first compensation resistor, and a second compensation resistor, and the first compensation resistor and the second compensation resistor are configured to convert an input reference current into a first output current, and the n-th compensation circuit comprises a n-th compensation resistor and a (n+1)-th compensation resistor to convert an input current into a n-th output current, wherein the first compensation circuit further comprises:

a first current to voltage (I/V) conversion circuit which comprises the first compensation resistor connected between an output terminal of the current source circuit and a ground, and the first I/V conversion circuit is configured to convert the reference current into a first internal voltage;

a first buffer configured to output the first internal voltage as a first output voltage;

a first voltage to current (V/I) conversion circuit which comprises the second compensation resistor connected between an output terminal of the first buffer and the ground, and the first V/I circuit is configured to convert the first output voltage into a first internal current; and a first current mirror configured to perform current mirroring for the first internal current of the first V/I conversion circuit to generate a first output current.

7. The reference current generation circuit of claim 6, wherein the first compensation resistor is configured to have a resistance value that is different from a resistance value of the second compensation resistor.

8. The reference current generation circuit of claim 6, wherein the first compensation resistor is configured to have a resistance value that is different from a resistance value of the second compensation resistor by a value equal to the process variation.

9. The reference current generation circuit of claim 6, wherein the input reference current is converted to the first output current based on a ratio of a resistance value of the first compensation resistor and a resistance value of the second compensation resistor.

10. The reference current generation circuit of claim 6, wherein the current source circuit further comprises:

a bandgap reference circuit configured to generate a reference voltage and provide the generated reference voltage to one end of the resistor of the current source circuit;

a second V/I conversion circuit comprising the resistor of the current source circuit, wherein the resistor of the of the current source circuit is connected to an output terminal of the bandgap reference circuit and a ground, and is configured to convert the reference voltage into a second internal current; and a current mirror circuit configured to perform current mirroring for the internal current input from the second V/I conversion circuit to generate the reference current.

11. The reference current generation circuit of claim 6, wherein the n-th compensation circuit comprises:

a n-th I/V conversion circuit which comprises an nth compensation resistor connected between an input terminal of the n-th compensation circuit and a ground, the n-th I/V conversion circuit is configured to convert the input current into a n-th internal voltage;

a n-th buffer configured to output the n-th internal voltage as a n-th output voltage;

a n-th V/I conversion circuit which comprises an n+1 compensation resistor connected between an output terminal of the n-th buffer and the ground, and the n-th V/I conversion circuit is configured to convert the n-th output voltage into a n-th internal current; and a n-th current mirror configured to perform current mirroring for the n-th internal current of the n-th V/I conversion circuit to generate a n-th output current.

12. A reference current generation circuit comprising:

a current source circuit configured to generate a reference current; and one or more compensation circuits, each of the one or more compensation circuits comprising a first compensation resistor of a first resistance value and a second compensation resistor of a second resistance value, and the first compensation resistor and the second compensation resistor are configured to convert the reference current into a first output current based on a ratio of the first resistance value and the second resistance value, wherein the one or more compensation circuit comprises:

a first current to voltage (I/V) conversion circuit comprising the first compensation resistor connected between an output terminal of the current source circuit and a ground, wherein the first compensation resistor is configured to convert the reference current into a first internal voltage;

a first buffer configured to output the first internal voltage as a first output voltage;

a first voltage to current (V/I) conversion circuit comprising the second compensation resistor connected between an output terminal of the first buffer and the ground, wherein the second compensation resistor is configured to convert the first output voltage into a first internal current; and a first current mirror configured to perform current mirroring for the first internal current of the first V/I conversion circuit to generate a first output current.

13. The reference current generation circuit of claim 12, wherein the resistance value of the first compensation resistor is different from the resistance value of the second compensation resistor.

14. The reference current generation circuit of claim 12, wherein the current source circuit further comprises a bandgap reference circuit configured to generate a reference voltage, and a voltage to current (V/I) conversion circuit configured to convert the reference voltage to an internal current.

15. The reference current generation circuit of claim 14, further comprising a current mirror circuit configured to perform current mirroring for the internal current to generate the reference current.

16. The reference current generation circuit of claim 12, wherein the first resistance value is different from the second resistance value by a value equal to a process variation of the current source circuit.

17. The current generation circuit of claim 12, wherein the first compensation resistor and the second compensation resistor are configured to convert the reference current into a first output current and compensate for process variation of the current source circuit.

18. The reference current generation circuit of claim 1, wherein the conversion of the reference current to the first output current includes performing a current to voltage conversion with respect to the reference current to generate the first output current based on a result of the current to voltage conversion.

* * * * *